United States Patent [19]

Kostusiak et al.

[11] Patent Number: 5,057,816

[45] Date of Patent: Oct. 15, 1991

[54] MULTIZONE INTRUDER DETECTION SYSTEM WITH FORCED WALK-TEST

[75] Inventors: Karl H. Kostusiak, Rochester; James E. Berube, Farmington, both of N.Y.

[73] Assignee: Detection System, Fairport, N.Y.

[21] Appl. No.: 576,013

[22] Filed: Aug. 31, 1990

[51] Int. Cl.[5] ..... G08B 29/00

[52] U.S. Cl. ..... 340/506; 340/509; 340/517; 340/518; 340/523; 340/526; 340/527; 340/528

[58] Field of Search ..... 340/506, 509, 517, 518, 340/523, 526, 527, 528, 541

[56] References Cited

U.S. PATENT DOCUMENTS 4,611,197 9/1986 Sansky ..... 340/527

OTHER PUBLICATIONS

Detection Systems DS7100, 130 Perinton Parkway, Fairport, N.Y., 14450, May 16, 1991.

*Primary Examiner*—Edward L. Coles, Sr.
*Assistant Examiner*—Nader Sayegh
*Attorney, Agent, or Firm*—Warren W. Kurz

[57] ABSTRACT

A multizone intruder detection system comprises a supervisory circuit for verifying, while the system is disarmed, that each of a plurality of intrusion sensors is, indeed, functional. The supervisory circuit inhibits re-arming of a disarmed system until it determines that each sensor has successfully operated within a relatively brief time interval just prior to the time an attempt is made to arm the system. A timing circuit, activated by a preliminary arm signal, operates to establish a time window (e.g. 10 minutes) within which the operability of each sensor must be verified (i.e. walk-tested) as a precondition to system arming. Preferably, the timing circuit is reset by each sensor alarm output, whereby the system user is given the full time window to walk-test each sensor. By virtue of the invention, sensor sabotage in a disarmed system can be mitigated.

7 Claims, 3 Drawing Sheets

MULTIZONE INTRUDER DETECTION SYSTEM WITH FORCED WALK-TEST

CROSS-REFERENCE TO RELATED APPLICATIONS

Reference is made to the commonly assigned U.S. application Ser. No. 07/576,055, filed concurrently herewith in the names of James E. Berube and entitled "Intruder Detection System With Passive Self-Supervision".

BACKGROUND OF THE INVENTION

The present invention relates to field of intrusion detection and, more particularly, it relates to improvements in multizone intrusion detection systems of the type which include a supervisory circuit for detecting the operability of the various intrusion-detecting sensors which define the different zones of protection.

An intrusion detection system in which the various intrusion-sensing elements are non-functioning is, of course, of psychological value only. Obviously, in a multizone system in which each zone of protection is defined by the field of view or detection range of each of a plurality of sensors (e.g., microwave, passive-infrared, photoelectric, ultrasonic, passive-acoustic, etc.), the level of security depends on the percentage of sensors which are functioning at any given time. Since a non-functioning sensor is not easy to detect without actually "walk-testing" the sensor to determine whether it produces an alarm output, it is becoming increasingly common to incorporate a so-called "supervisory" circuit in such systems to monitor the operating status of each sensor (or at least those which are particularly prone to fail). Such circuit operates to activate a "supervisory" alarm (e.g., a light-emitting diode) to alert the user of any sensor failure. Detection systems incorporating such supervisory circuits are disclosed, for example, in the commonly assigned U.S. Pat. No. 4,660,024 to R. L. McMaster.

In the commonly assigned U.S. application Ser. No. 492,482, filed on Mar. 12, 1990 in the name of W. S. Dipoala, there is disclosed a dual-technology (passive-infrared/microwave) intruder detection system in which both sensors are "actively" supervised by periodically simulating, within the system, a target of interest. In the event of either sensor failure, a supervisory alarm is given. While such "active" supervision provides optimal protection against sensor failure, it does so at the expense of requiring target-simulation apparatus within each sensor device.

Recently, it has become known to "passively" supervise the various sensors of a multizone system by monitoring the pedestrian-produced activity of the sensors during the period that the system is disarmed, e.g., during the daylight hours in which the protected premises are being used by the owner of the system. The supervisory apparatus includes a display which indicates which of the several sensors have been activated during the disarm period and, hence, are functional; it also, of course, indicates those which have not been activated. To prevent the system from being re-armed without having the operability of those non-activated sensors verified (e.g., by walk-testing), such control device can be programmed to inhibit re-arming until it detects that all sensors have been activated. While this arrangement provides a high degree of security, it can be a nuisance to a user who, for example, arms the system after verifying that all sensors are functional and then realizes that he forgot something inside the protected premises. To re-enter such premises, even for a moment, means that he must walk-test all sensors, since there is no intervening traffic to do this job for him. Because of this inconvenience, there may be some reluctance on the part of the security customer to opt for this very effective passive supervisory feature.

In the commonly assigned U.S. application Ser. No. 07/576,055, filed concurrently herewith in the name of James E. Berube and entitled "Intruder Detection System With Passive Self-Supervision", there is disclosed a multizone intruder detection system which includes a timing circuit for establishing a time interval during which the system user can re-arm a disarmed system without paying the afore-mentioned penalty of having to walk-test all sensors. So long as the user re-arms the system in, say, one hour after disarming, he need not cause an arm-enable signal to be generated from the passive supervisory circuit. While this apparatus renders the system far more "user-friendly" there is some risk that one or more of the sensors may be sabotaged, or inadvertantly masked, during the disarm period, after the time it has produced a sensor alarm for the supervisory circuit. For example, after a passive-infrared sensor has been activated, someone may set a box or the like directly in front of the sensor. While the supervisory circuit is satisfied that the sensor operates, the sensor will be totally ineffective in sensing intrusion during the succeeding arm period. Thus, it will be appreciated that the afore-described passive supervision technique may be convenient, but not provide optimal protection. To assure maximum security, each sensor must be walk-tested as close to the time of arming as possible.

SUMMARY OF THE INVENTION

With the above ideal in mind, an object of this invention is to provide a multizone security system which "forces" the user to verify (e.g. by walk-testing) the operability of each sensor immediately prior to arming the system.

By virtue of a preferred embodiment of the present invention, a disarmed, multizone intruder detection system embodying the aforedescribed supervision feature is re-armable only if all of the intrusion sensors have been activated during a relatively brief time interval immediately prior to attempting to arm the system. The apparatus of the invention is characterized by a timing means which operates to establish a timing window (e.g. 10 minutes) within which the operability of each sensor must be verified as a precondition to re-arming. Preferably, the timing means is reset by each sensor alarm output, whereby the system user is given the full time window to walk-test each sensor. The advantageous technical effect of the invention is that sensor sabotage, either intentional or self-inflicted is mitigated.

According to a particularly preferred embodiment, the "forced" walk-test feature of the invention is combined with the aforementioned programmed timer which allows the user to re-arm the system within a brief period of time immediately after disarming the system.

The invention and its various advantages will become better understood from the ensuing detailed description of preferred embodiments, reference being made to the accompanying drawings.

DETAILED DESCRIPTION OF PREFERRED EMBODIMENTS

Figure 1:
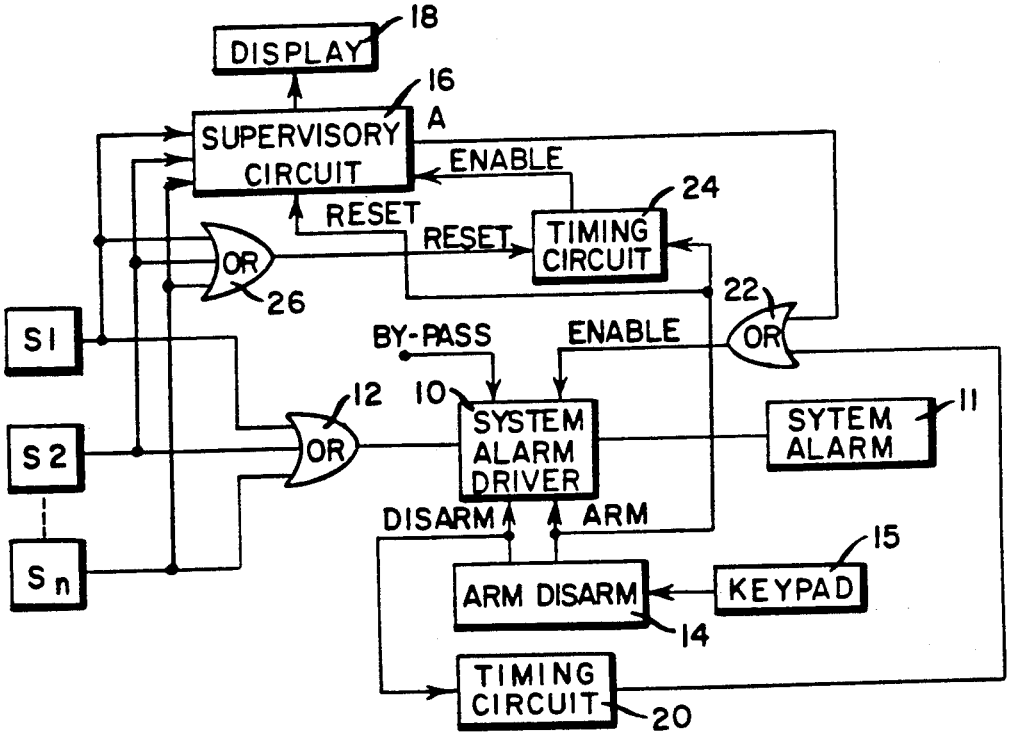
FIG. 1 is a functional block diagram of a multizone intruder detection system embodying the present invention.

Referring now to the drawings, FIG. 1 schematically illustrates a multizone intruder detection system embodying the invention. Such system comprises a plurality of intrusion sensors S1–SN, each having its own discrete field of view or zone of protection within a region protected by the system. Each of the intrusion sensors may take any of a variety of forms adapted to sense some characteristic of intrusion, e.g., a change in thermal energy, a disturbance of standing waves of ultrasonic or microwave energy, a change in position of an object, such as a door or window, a change in noise level, etc. Each intrusion sensor is adapted to produce a sensor alarm signal on its output in response to a predetermined type of change in the intrusion characteristic for which it was designed.

The respective outputs of sensors S1–SN are connected to the input of a system alarm circuit 10 through a logical OR gate 12. When armed, as described below, system alarm 10 is designed to activate a system alarm 11, such as an audible noise source or a message communication system, e.g., an automatic telephone dialer, in the event any one of the different intrusion sensors detects intrusion and produces a sensor alarm.

Arming and disarming of system alarm 10 is achieved by an arm/disarm circuit 14 which applies either of two different voltages to the system alarm. When an "arming" voltage is applied, the system alarm is still not responsive to the sensor alarms to activate the system alarm until it receives an "enable" signal from a logical OR gate 22, as explained below. When a "disarm" voltage is applied, the system alarm is immediately rendered non-responsive to the sensor alarms, and the user may enter and move about the protected premises without any concern that a system alarm will be sounded. The output of arm/disarm circuit 14 may be manually controlled via by manually operated switches which form a part thereof, or it may be controlled from a remote location by a keypad 15, as is well known in the art.

Figure 2:
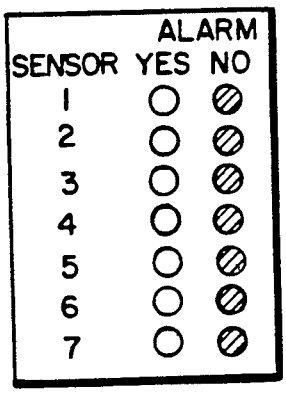
FIG. 2 is a typical supervisory display useful in the FIG. 1 system.

In a conventional manner, the "activity" of each of the intrusion sensors is monitored by a supervisory circuit 16 which, when rendered operative by an enable signal provided by a timing circuit 24 (explained below), operates to exhibit on a display 18 (FIG. 2), which of the sensors have produced a sensor alarm since the most recent attempt to arm the system has been made. Note, the supervisory display is reset (to show that none of the sensors has alarmed) each time an "arm" signal is produced. The supervisory circuit comprises a logical AND gate which produces an "arm-enable" signal on its output A only in the event all of the intrusion sensors have shown activity (i.e. produced a sensor alarm) since the most recent "arm" signal was produced. This "arm-enable" signal is applied to system alarm circuit 10, via OR gate 22 to allow re-arming of the system following a disarm period.

It will be appreciated that, at the time the system user attempts to arm the system (by causing circuit 14 to produce an "arm" signal, there is no "arm-enabling" output from the supervisory circuit. Indeed, the "arm" signal provided by circuit 14 operates to reset the supervisory circuit so that it has seen no activity from the intrusion sensors. Now, in accordance with the invention, to assure that each sensor has been successfully tested just prior to system arming, a timing circuit 24 is operative connected between the arm/disarm circuit 14 and the supervisory circuit 16. In response to an "arm" signal, the timing circuit produces a "supervisory-enable" signal on it output for a predetermined time window, preferably about 10 minutes. This enable signal serves to render the supervisory circuit operative for the signal's duration (10 minutes). During this period, the system user is required to "walk-test" at least one of the intrusion sensors to produce a sensor alarm therefrom. If, for example, sensor S1 is "violated", the output of this sensor will be detected by the supervisory circuit and displayed on the display 18. Note, by virtue of an OR gate 26, the respective outputs of all sensors is used to reset the timing circuit to give the system user another full time window to walk-test the next sensor. Assuming the walk-tests of all sensors have been successfully performed before circuit 24 times out, then an arm-enabling signal will be provided to the system alarm, and the latter will be responsive to individual sensor alarms to produce a system alarm.

The multizone, self-supervised, intruder detection system shown and described to this point provides extremely high security in that the system is virtually immune to sensor sabotage. A disadvantage of this system, of course, is that it requires a considerable investment of time on the part of the system user who must walk-test each sensor before arming the system. This requirement is particularly incovenient to one who has a need to re-enter the protected premises before the time at which the system is normally disarmed. For example, should the system user arm the system, and then recall that he forget to perform some task within the now-protected premises, he will suffer the disadvantage of having to again "walk-test" all of the intrusion sensors should he decide to disarm the system to attend to that task. This inconvenience is, of course, compounded as the number of sensors increases.

Now, in accordance with another aspect of this invention, the above-described disadvantage is largely mitigated by the provision of a second programmable timing circuit 20. Preferably, timing circuit 20 operates to produce a continuous signal on its output terminal for a predetermined time interval following receipt of a signal at its input. As shown, the timing circuit's input signal is provided by "disarm" signal produced by circuit 14. Together with the output of the supervisory circuit (indicating whether or not all supervised sensors have produced a sensor alarm after the most recent arm signal has been produced), the output of timing circuit 20 is supplied to the inputs of a logical OR gate 22. If either input is present, OR gate 22 provides an "arm-enable" signal to the system alarm driver circuit, allowing such circuit to respond to the sensor alarm signals. Preferably, the time interval of timing circuit 20 is about one hour. Such a period of time is usually sufficiently long to enable a system user to accomplish what has to be done "after hours", yet is sufficiently short to allow ample time for the supervisory circuit the sensor alarms it requires to produce the requisite "arm-enable" signal after the system has been disarmed, e.g., at the beginning of the business day.

Figure 3:
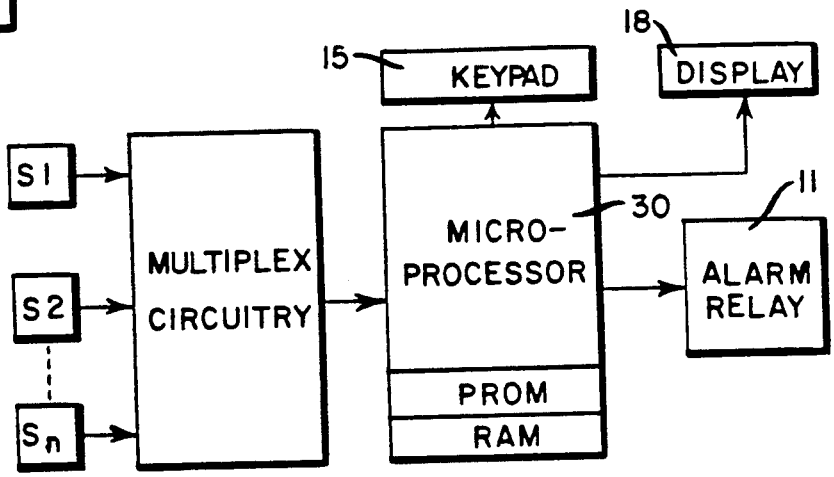
FIG. 3 is a functional block diagram of a microprocessor-controlled multizone intruder detection system embodying the invention.
Figure 4:
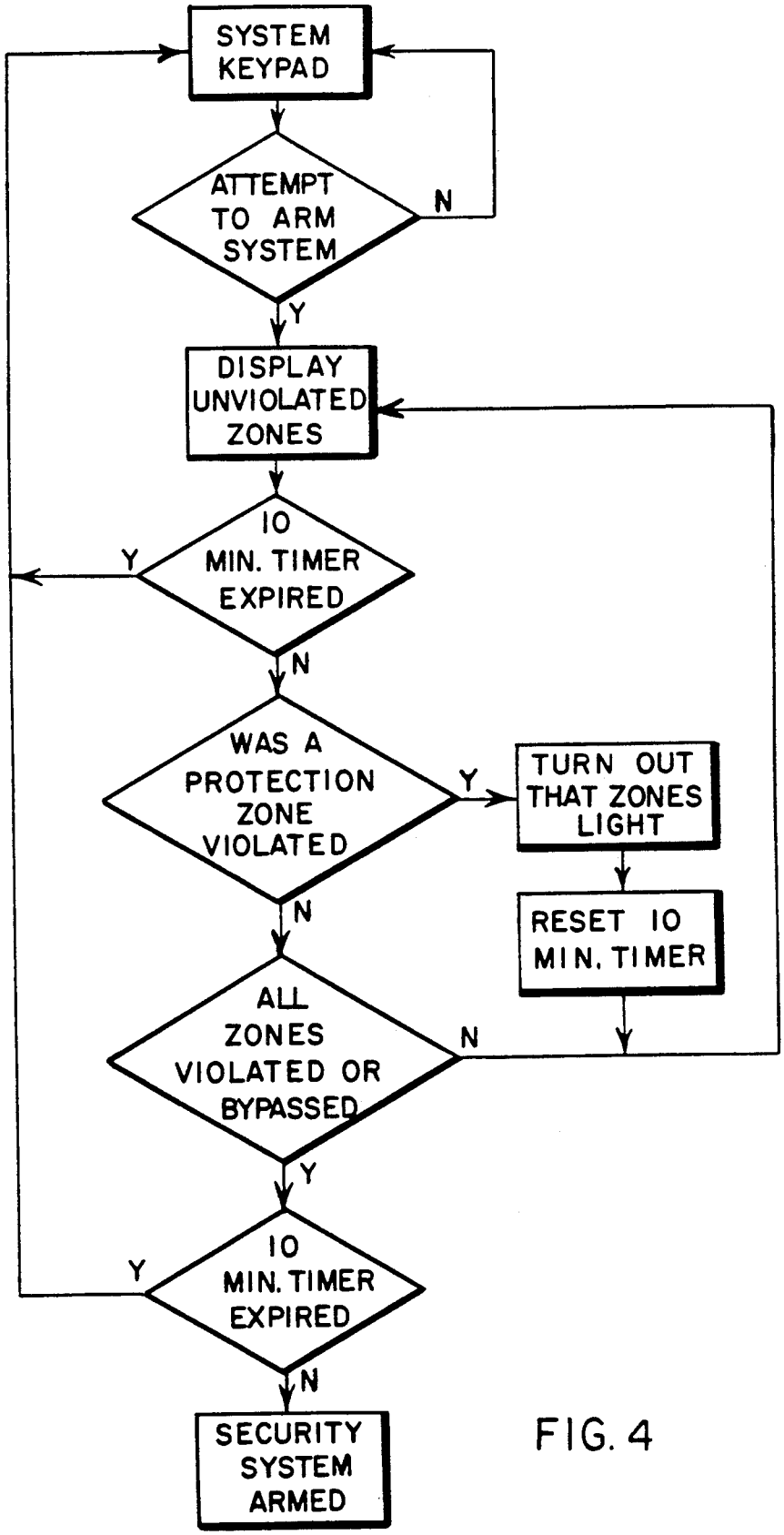
FIGS. 4 and 5 are flow charts illustrating preferred programming of the microprocessor used in the FIG. 3 system.
Figure 5:
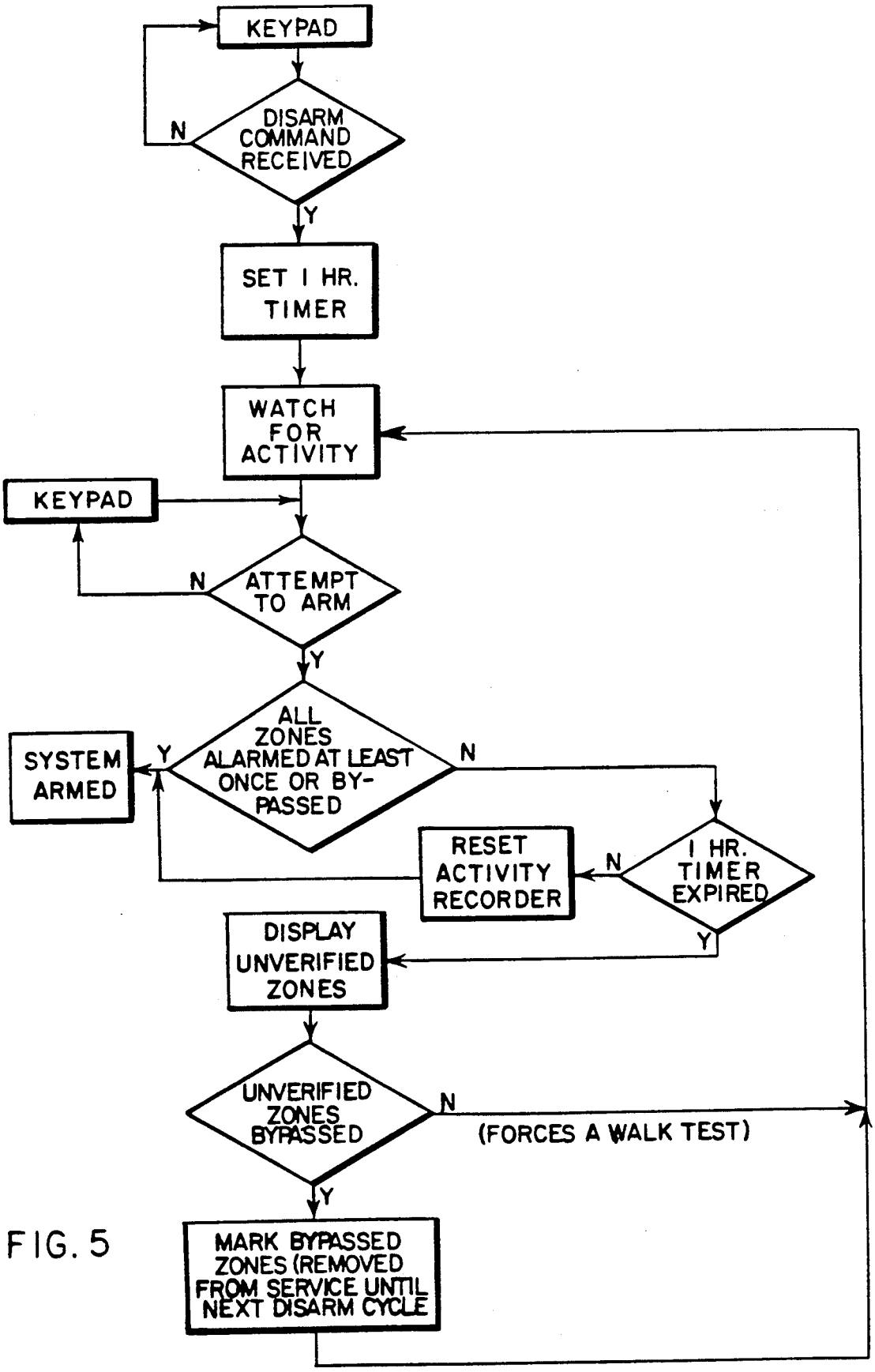

While the apparatus of the invention can be embodied in the hardware shown in FIG. 1, the functions of such hardware, of course, can be provided by a suitably programmed microprocessor 30, shown in FIG. 3, having a programmable read-only memory (PROM) and a random access memory (RAM). Arming and disarming of the system is effected by keypad 15 which communicates with the microprocessor in a well known manner. Such microprocessor may be programmed to carry out the programs shown in the flow-chart of FIG. 4, where it is assumed that the "forced walk" timer is programmed to "time-out" and thereby discontinue producing an output after ten minutes, and the "convenience" timer is programmed to time-out after one hour.

While the invention has been described with reference to preferred embodiments, it will be appreciated that many modifications can be made without departing from the spirit and scope of invention, as defined by the appended claims.

What is claimed is:

1. A multizone intruder detection system for detecting intrusion in any one of a plurality of zones of protection in a region under surveillance, said system comprising:

(a) a plurality of intrusion sensors, each providing discrete zones of protection and being adapted to produce a sensor alarm signal in response to sensing a characteristic of intrusion occurring in its associated zone of protection;

(b) system-alarm means selectively responsive to a sensor alarm signal being produced by any one or more of said intrusion sensors to produce a system alarm, said system-alarm means being responsive to an arm-enable signal and an arming signal applied thereto in order to be responsive to a sensor alarm;

(c) system arming/disarming means for selectively applying arming and disarming signals to said system-alarm means, said disarming signal rendering said system-alarm means non-responsive to said sensor alarms;

(d) supervisory means, selectively responsive to an applied supervisory-enable signal, for monitoring the operability of at least some of said intrusion sensors by detecting the production of sensor alarm signals from each of the monitored intrusion sensors, said supervisory means being adapted to produce said arm-enable signal in the event that all of the monitored intrusion sensors produces a sensor alarm while said supervisory-enable signal is applied thereto; and (e) timing means, responsive to the application of an arm signal to said system-alarm means, for continuously applying said supervisory-enable signal to said supervisory means for a predetermined time interval.

2. The apparatus as defined by claim 1 wherein said system alarm means is responsive to a manually produced by-pass signal to allow arming of the system in the absence of said arm-enable signal being applied to said system alarm means.

3. The apparatus as defined by claim 1 wherein said timing means is programmable to vary said predetermined time interval.

4. The apparatus as defined by claim 1 wherein said supervisory means comprises a display for displaying which of said sensors has produced a sensor alarm signal after said system has been most recently armed, said supervisory means being responsive to an arm signal produced by said system arming/disarming means to reset said display to indicate that none of said intrusion sensors has produced a sensor alarm signal.

5. The apparatus as defined by claim 1 wherein the elements described in paragraphs (b) through (e) are embodied in a programmable microprocessor.

6. The apparatus as defined by claim 1 wherein said timing interval is reset whenever a sensor alarm is produced.

7. The apparatus as defined by claim 1 further comprising second timing means, operatively connected to said arming/disarming means for producing a second arm-enable signal for a preselected time interval immediately following the production of a disarming signal, and circuit means for applying either of said arm-enable signals to said system-alarm means.

* * * * *